US005483762A

United States Patent [19]

Hogan

[11] Patent Number: 5,483,762

[45] Date of Patent: Jan. 16, 1996

[54] ART FRAMING MAT

[76] Inventor: Sherman D. Hogan, P.O. Box 57638, Salt Lake City, Utah 84157

[21] Appl. No.: 160,221

[22] Filed: Dec. 2, 1993

[51] Int. Cl.[6] ..... B44C 5/02

[52] U.S. Cl. ..... 40/158.1; 40/154; 40/427

[58] Field of Search ..... 40/158.1, 154, 40/427

[56] References Cited

U.S. PATENT DOCUMENTS 593,036 11/1897 Stuparich ..... 40/158.1

611,238 9/1898 Drinkaus ..... 40/158.1

1,805,436 5/1931 Barnard ..... 40/154

*Primary Examiner*—Kenneth J. Dorner

*Assistant Examiner*—Cassandra Davis

[57] ABSTRACT

An art forming mat having at least one interior space to receive a picture or art object and with a border around and defining the interior space including at least one additional interior space formed in the border and each interior space surrounded by parallel embossed interspersed strips between and adjacent the spaced strips.

3 Claims, 2 Drawing Sheets

ART FRAMING MAT

BACKGROUND OF THE INVENTION

1. Field of the Invention

This invention relates to the production of framed pictures and other objects commonly displayed as wall hangings.

2. State of the Art

Presently, in the framing of pictures and other objects to be displayed while hanging on a wall, supported on a stand, or otherwise positioned for display purposes, a series of overlying mats, cut to provide a three-dimensional or depth appearance, are used. With these known mat structures a first mat provides a first border around the picture or other object to be displayed. Another mat overlies the first mat and is cut to form a second border around the picture or object to be displayed. Often a third and even additional mats are used to provide a third and subsequent borders. Each border after the first is spaced further away from the picture or other object being framed such that the color and texture of each mat used is visible as a border and each border after the first is positioned such that the thickness of the mat from which border is made closer to the eye of a viewer. This results in a three-dimensional border effect. A frame may be provided to surround the last of the mats used to form a border. The three-dimensional border effectively directs the gaze of a viewer to the centrally located picture or other framed object and is a popular way of preparing a picture or other object to be displayed.

The multi-mat border display system has several drawbacks, however. In order to be properly used, the system must be prepared, with the separate mats cut to provide desired border widths, color and texture and the composite border formed by the individually cut mats must be balanced as to composition, color, texture and border widths to present a suitable overall appearance. This is generally accomplished by persons having special artistic skills and, when attempted by persons without such skills or training to overcome a lack of inherent skills the results are often less than satisfactory. The equipment commonly used to provide the multi-mat border effect is large and expensive. Furthermore, persons skilled or trained often charge more for their services in this area than many people can afford.

Consequently, there is a need for a system of framing pictures and other objects that more people can use and afford.

SUMMARY OF THE INVENTION

The present invention provides a system for providing a border around a picture or other object that uses a single mat but that achieves a three-dimensional appearance for the border.

It is a principal object of the present invention to provide a single mat having a border that will surround a picture or other object such that a three-dimensional effect is obtained for the border.

Another object is to provide a low cost system for providing a border around a picture or other object that can be used by virturally anyone and that, when assembled, will closely resemble a framed picture, or other object, surrounded by a border made from a plurality of mats properly cut and positioned to provide a desired three-dimensional border effect.

The principal feature of the invention is a single, one-piece embossable sheet or mat which may take the form of a lithographic mat and may be of any desired size. The mat is formed with a series of edge lines, or strips, printed and embossed as a border to surround an interior space that may contain a picture or other object.

In one preferred embodiment at least one interior space is an opening provided through the one-piece sheet of textured paper mat and each opening that is provided is cut-out and is surrounded by a border that includes spaced apart strips interspersed with embossed strips. In another embodiment a picture is printed onto the mat formed to have a border and within an interior space defined by the border. More than one defined interior space may be provided in one mat and the defined interior space may be cut-out or have a printed picture or other object therein.

More than one interior space with a border may be provided in a mat into a frame and the defined interior space may take different shapes as diverse as birds, fish, animals, automobiles, caricatures, logos, numbers, symbols, etc. and may themselves form part of a border. In addition, such special shapes may be printed flat or may be embossed onto the border at desired locations.

The strips may be of the same texture, each interspersed strip may be of the same texture or the interspersed strips may each be given a different texture. The interspersed strips are embossed and made to stand away from the flat mat to selected distances. Each subsequent interspersed embossed strip spaced away from the interior space surrounded by the border may be made to stand away further than the adjacent interspersed strip nearer to the interior space. Alternatively, the interspersed strips may be made to each stand away in relief to the same degree or the relief may be varied in other desired patterns. The different texturing of strips, together with the embossing of the strips adds to a three-dimensional effect obtained with the single mat of the invention. The single mat of the invention thus effectively provides an easy to use replacement for the multiple mats heretofore used. Such a mat can be produced inexpensively and can be used even by untrained persons.

A unique border treatment can be obtained by impregnating the mat with a solution that will cause the mat to change color in response to temperature changes. The user can then provide heating and cooling apparatus to change the atmospheric temperature in the area of the object displayed and thereby change the overall appearance of the object displayed.

Additional objects and features of the invention will become apparent form the following detailed description, taken together with the accompanying drawing.

THE DRAWING

In the drawing:

FIG. 1 shows a top plan view of a picture frame and a mat of the invention;

FIG. 2, a fragmentary sectional view taken through an embossed border;

FIG. 3, a view like that of FIG. 2, showing another embodiment of embossed border; and FIG. 4, a view like that of FIGS. 2 and 3, but showing still another embodiment of embossed border.

DETAILED DESCRIPTION

Figure 1:
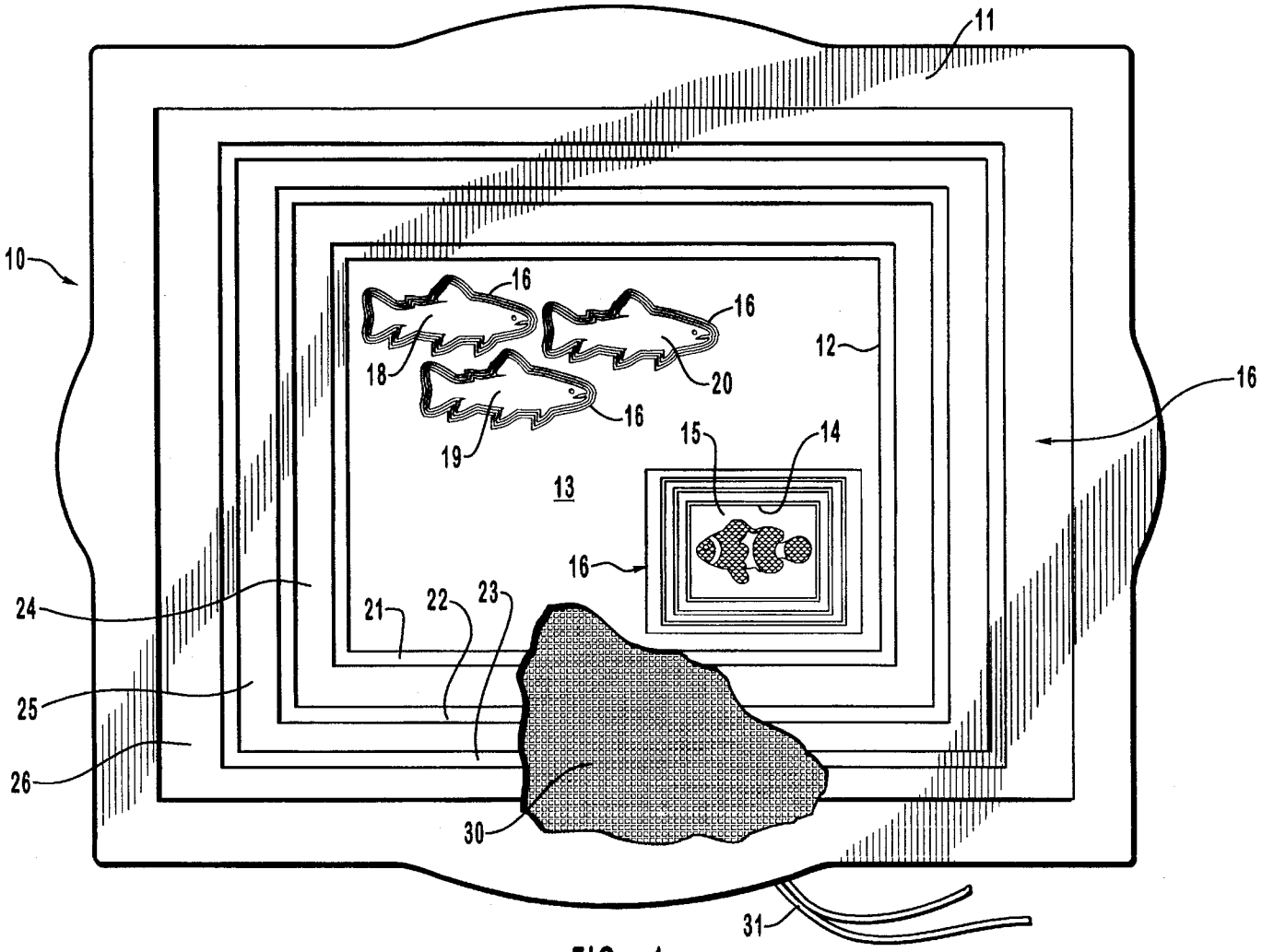

Referring now to the drawing:

In the illustrated preferred embodiment the art framing mat of the invention is shown generally at 10 positioned within a picture frame 11. As shown, mat 10 has a cut-out interior space 12 surrounded by a border 16, into which is fitted a separate picture 13 and another interior space 14 containing a picture 15, printed on the mat. It will be apparent that the mat 10 may be made to have a border 16 surrounding an interior space containing an art object other than a picture.

The art framing mat 10 is made of a suitable embossable sheet material, such as paper, and is surrounded by the frame 11, which may be of standard construction. Any sheet material capable of being embossed, i.e. paper, aluminum foil, etc. can be used, however.

Mat 10 has the central defined cut-out interior space 12 formed therein. The border, shown generally at 16, surrounds the cut-out interior space 12 and is positioned within the frame 11.

Also in the embodiment of the invention shown in FIG. 1, a picture of a partial flag 15 is shown printed on mat 10 in a second interior space 14 that is located adjacent one side of mat 10 and that is surrounded by another border 16.

Other pictures 18, 19 and 20, respectively positioned in the mat 10, each depict a fish, with each fish in the mat made larger as such fish is more remote from the central defined cut-out opening 12 and with each fish being embossed and surrounded by a border 16. The embossed fish, either with or without separate borders 16, can also be positioned to be part of the border 16 surrounding the defined opening 12.

Each border 16 includes a plurality of spaced apart, strips 21, 22, and 23 formed in continuous or broken form around the interior space 12 and/or 14 or the other pictures 18, 19, and 20, and in any desired shape. Thus, each strip may form a rectangle, a circle, an oval, or any desired irregular shape. The strips 21, 22, and 23 are often each lighter in color than strips 24, 25 and 26 that respectively separate the strips 21 and 22, and strips 22 and 23, and strip 23 and the frame 11. Preferably, the spaced apart strips 21, 22 and 23 are each white in color. Such color distinctions add to the three dimensional appearance achieved by use of mat 10. However, even when all strips are the same color the shadows occurring from the embossed strips insure a desired three dimensional effect.

Figure 2:
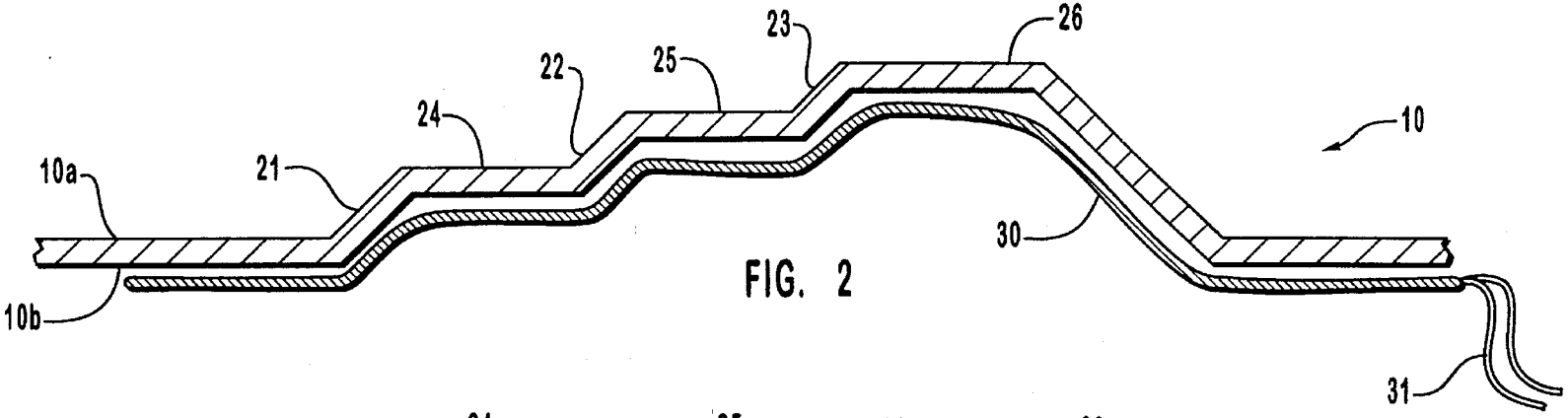

The strips 24–26 are embossed, with the strips standing away from the mat in relief. The distance the strips extend away from the base mat surface may vary with each strip and become greater as the strips are spaced from opening 12, as shown in FIG. 2. The strips 21–23 may include any irregular mat surface required to interconnect adjacent strips 24–26.

Figure 3:
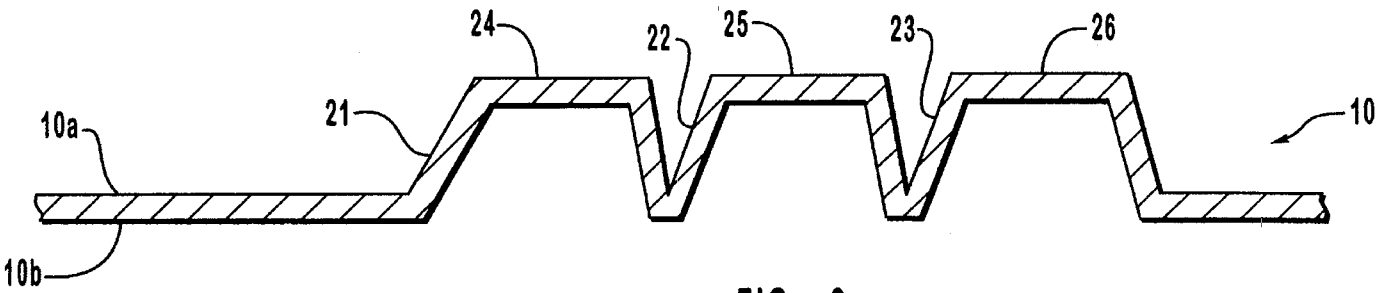

As shown in FIG. 3, the strips 24, 25 and 26 may be embossed to stand away in relief, with each strip extending from the base an equal distance.

Figure 4:
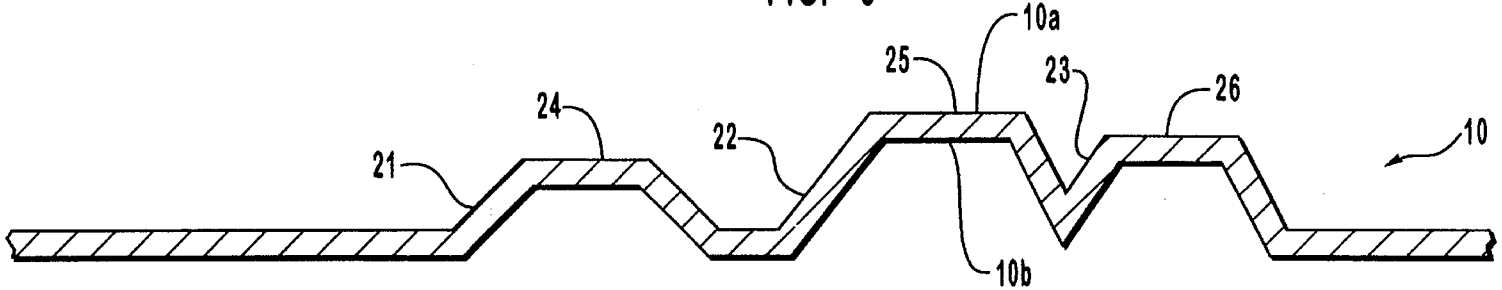

In FIG. 4, the strips 21, 22 and 23 are shown as extending to varying distances from the base.

The border 16, with the spaced apart, strips 21, 22, and 23 and the interspersed strips 24, 25 and 26, colored as described, and in varying relief, provides a single sheet mat with the general appearance of the multiple mats previously used in picture framing. Such single mat is readily pre-made, is easily used, even by untrained persons and is economical to use.

While three strips and three interspersed strips are disclosed in the presently preferred embodiment, more or fewer strips and interspersed strips may be used.

The mat 10, if made of paper or other absorbing material, can be readily impregnated with a conventional suitable color change solution that will allow the mat to change colors in resonse to temperature changes. A user then may arrange heating and cooling apparatus to change the temperature in the vicinity of the mat to provide a desired color change when desired. As shown, a flexible heating composite sheet 30, made of thin plastic layers having flexible heting elements embedded therein is provided as a backing member for the mat 10. The composite sheet 30 has a connector card 31 electrically attached to the heating elements and to be connected to a suitable source of power, i.e., a wall outlet, a battery, or a solar power collector, for example.

While the invention has been herein described with reference to the presently preferred embodiment, the invention is intended to encompass all embodiments coming within the scope of the following claims, as well as reasonable equivalents thereof.

I claim:

1. An art frame mat comprising a single sheet of embossable material having at least one defined interior space including a front and positioned within a border, said border including a plurality of spaced apart strips surrounding said interior space and a plurality of interspersed strips surrounding said interior space adjacent to said spaced apart strips, at least one of said spaced apart strips being embossed to stand away from the front of said interior space, and wherein said sheet of embossable material is impregnated with a temperature sensitive color change material.

2. An art framing mat as in claim 1, further including means for heating said sheet of embossible material.

3. An art frame mat comprising a single sheet of embossable material having a first defined interior space including a front and positioned within a first border, said border including a plurality of spaced apart first strips surrounding said first interior space and a plurality of first interspersed strips surrounding said first interior space adjacent to said spaced apart first strips and, at least one second defined interior space formed in said first border, said second defined interior space including a front surrounded by a second border including second embossed strips and second interspersed strips, with said second interspersed strips being adjacent to said second strips and with said second interspersed strips standing away in relief from said front of said second defined space and not concentric with said first border, whereby said second defined space is adapted to receive a design therein that is independent of said first defined interior space.

* * * * *